US010321755B1

(12) United States Patent
Sie

(10) Patent No.: US 10,321,755 B1
(45) Date of Patent: Jun. 18, 2019

(54) ELEVATING APPARATUS OF TABLE

(71) Applicant: Fong-Lung Sie, Tainan (TW)

(72) Inventor: Fong-Lung Sie, Tainan (TW)

(73) Assignee: Jing Hao Enterprise Co., Ltd., Tainan (TW)

( * ) Notice: Subject to any disclaimer, the term of this patent is extended or adjusted under 35 U.S.C. 154(b) by 0 days.

(21) Appl. No.: 16/053,961

(22) Filed: Aug. 3, 2018

(51) Int. Cl.
*A47B 9/06* (2006.01)
*A47B 21/02* (2006.01)

(52) U.S. Cl.
CPC ..... *A47B 9/06* (2013.01); *A47B 21/02* (2013.01); *A47B 2009/065* (2013.01)

(58) Field of Classification Search
CPC .... A47B 9/06; A47B 9/10; A47B 9/20; A47B 2200/0051; A47C 3/30; A47C 3/40
USPC ..... 108/147, 144.11, 144.19, 147.19; 248/188.2, 188.5
See application file for complete search history.

(56) References Cited

U.S. PATENT DOCUMENTS 3,080,835 A * 3/1963 Guglielmi ..... A47B 9/10 108/116
3,140,559 A * 7/1964 Grow ..... A47B 27/06 108/10
3,273,517 A * 9/1966 Amthor, Jr. ..... A47B 27/14 108/140
3,905,311 A * 9/1975 Carpentier ..... A47B 9/02 108/136
4,627,591 A * 12/1986 Heckmann ..... A47B 9/06 108/148
4,981,085 A * 1/1991 Watt ..... A47B 9/02 108/146
5,370,063 A * 12/1994 Childers ..... A47B 9/06 108/143
5,408,940 A * 4/1995 Winchell ..... A47B 9/06 108/10
5,598,788 A * 2/1997 Jonker ..... A47B 9/10 108/147
6,345,547 B1 * 2/2002 Stoelinga ..... A47B 9/06 108/147
7,412,931 B2 * 8/2008 Seidl ..... A47B 9/02 108/147
8,661,989 B2 * 3/2014 Tsai ..... A47B 9/04 108/10
8,985,032 B1 * 3/2015 Johnson ..... A47B 21/02 108/106
2011/0061570 A1 * 3/2011 Klinke ..... A47B 9/20 108/20
2015/0047538 A1 * 2/2015 Ergun ..... A47B 9/02 108/147

(Continued)

*Primary Examiner* — Jose V Chen
(74) *Attorney, Agent, or Firm* — Rosenberg, Klein & Lee

(57) ABSTRACT

An elevating apparatus of a table is disclosed. It mainly comprises a height adjusting apparatus having a gas spring inserted into an inner column of each of two legs respectively, a chute disposed outside the inner column and corresponding to a guide rail of a hollow outer column, a guide gear pivotally connected to a teeth-guiding slot of the hollow outer column, a gear rack disposed at one side of the inner column adjacent to the guide gear, and a pulley pivotally connected to a pulley slot of the hollow outer column for contacting the inner column, wherein two lateral sides of the chute are provided with plural arc portions equally spaced apart from each other for contacting the guide rail.

5 Claims, 7 Drawing Sheets

(56) References Cited

U.S. PATENT DOCUMENTS

| | | | | |
|---|---|---|---|---|
| 2016/0095425 | A1* | 4/2016 | Yang | A47B 9/06<br>248/188.2 |
| 2018/0213927 | A1* | 8/2018 | Sudoh | A47B 9/10 |
| 2018/0317645 | A1* | 11/2018 | Stoelinga | A47B 9/06 |

* cited by examiner

ELEVATING APPARATUS OF TABLE

BACKGROUND OF THE INVENTION

1. Field of the Invention

The present invention relates to an elevating apparatus of a table which adjusts a height of the table conveniently by non-tilted elevating or lowering an inner column inside a hollow outer column of each of plural legs of the table synchronously and successfully so as to achieve effects of diverse application by different users and increasing practicality in its overall application.

2. Description of Related Art

Different types of tables are widely used by people in daily life for putting various things on them to dine, work or study. Therefore, different types of tables are essential in daily life.

Many types of tables are not suitable for every user due to different heights and usage habits of the users, so a height adjusting apparatus for a table is developed. In use of the height adjusting apparatus, plural gas springs are disposed between a table board and plural legs at two laterals to adjust the height of the table by elevating or lowering the gas springs for different users.

Although the aforementioned height adjusting apparatus for a table can be used for adjusting the height of the table, the table board is usually tilted when the gas springs are adjusted. Furthermore, the gas springs are disposed between the table board and the legs for adjusting the height of the table, and the legs are usually disposed at two laterals instead of a central region of the table board due to considering a placement position for a user's feet and usage habits, so the gas springs are usually disposed at two laterals of a table. In such a case, the gas springs are prone to tilt and not adjusted smoothly to drive the table to move upwards or downwards, leading to difficulties in adjusting the gas springs synchronously and inconvenience in operating. Therefore, improvement of a whole design of the aforementioned height adjusting apparatus is needed.

SUMMARY OF THE INVENTION

The present invention relates to an elevating apparatus of a table which adjusts a height of the table conveniently by non-tilted elevating or lowering an inner column inside a hollow outer column of each of plural legs synchronously and successfully so as to achieve effects of diverse application by different users and increasing practicality in its overall application.

The elevating apparatus of a table of the present invention comprises a board, two legs and a height adjusting apparatus.

The two legs are connected to two lateral members of a bottom of the board respectively. Each of the two legs is provided with a leg base at a bottom thereof, a hollow outer column disposed on the leg base and having a guide rail on at least one internal side thereof, a teeth-guiding slot disposed at one side adjacent to the at least one internal side thereof and a pulley slot disposed at another side corresponding to the teeth-guiding slot, and an inner column movably inserted into the hollow outer column and connected to the board at a top side thereof.

The height adjusting apparatus is provided with a gas spring inserted into the inner column of each of the two legs, a chute disposed outside the inner column corresponding to the guide rail of the hollow outer column, a guide gear pivotally connected to the teeth-guiding slot of the hollow outer column, a gear rack disposed at one side of the inner column adjacent to the guide gear for correspondingly engaging with the guide gear, and a pulley pivotally connected to the pulley slot of the hollow outer column for contacting the inner column. The chutes are provided with plural arc portions equally spaced apart from each other at two lateral sides thereof for contacting the guide rail.

According to an embodiment of the present invention, the hollow outer column of each of the two legs is preferably provided with two guide rails corresponding to each other on two opposite internal sides thereof.

According to an embodiment of the present invention, the height adjusting apparatus is provided with a supporting base connected to a bottom of the inner column and having a supporting pulley pivotally connected to one side of the supporting base corresponding to the pulley for contacting the internal side of the hollow outer column.

According to an embodiment of the present invention, the height adjusting apparatus is provided with a control portion on the gas spring and having an elevating control lever for controlling the control portion synchronously.

According to an embodiment of the present invention, an axle is further provided to synchronously connect the two guide gears pivotally connected to the two hollow outer columns of the two legs.

DETAILED DESCRIPTION OF THE PREFERRED EMBODIMENT

To provide a thorough understanding, the purpose and advantages of the present invention will be described in detail with reference to the accompanying drawings.

Figure 1:
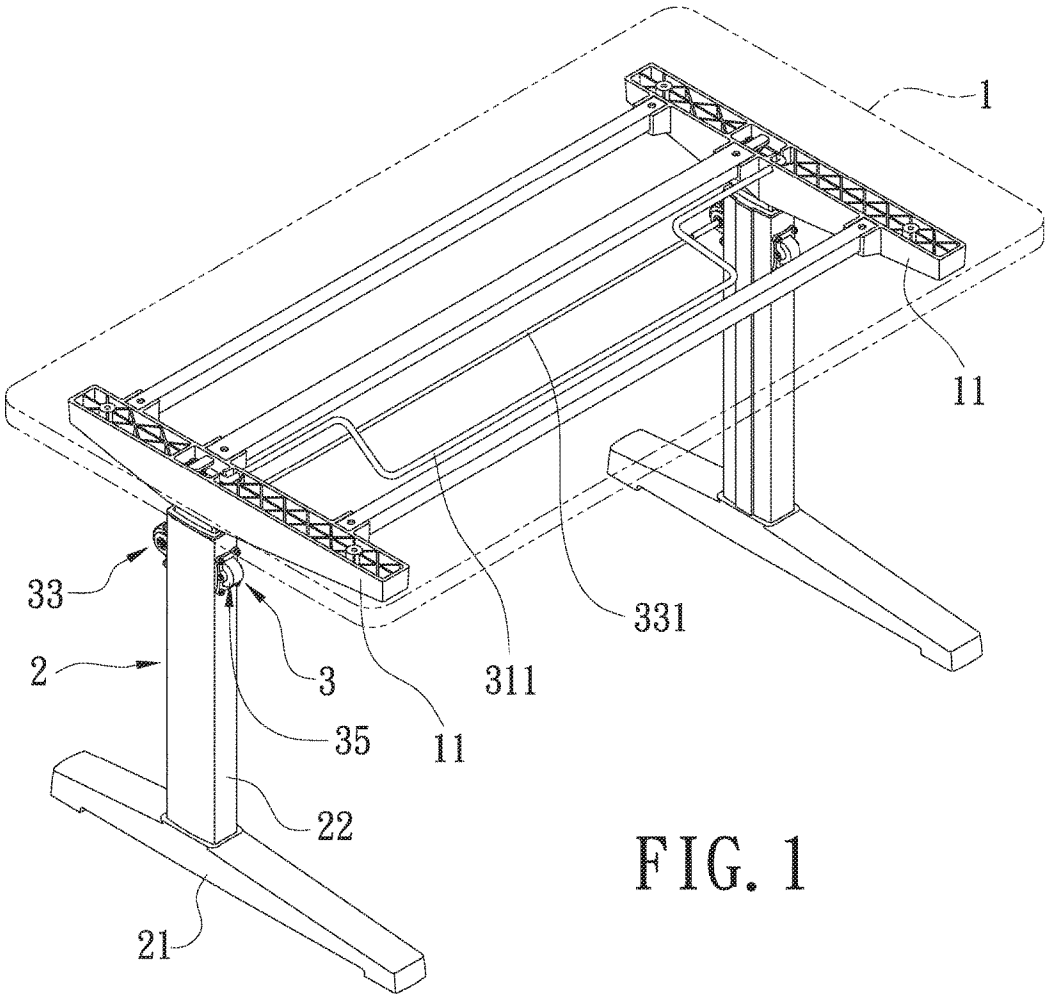
FIG. 1 is a stereogram showing an elevating apparatus of a table according to the present invention.
Figure 2:
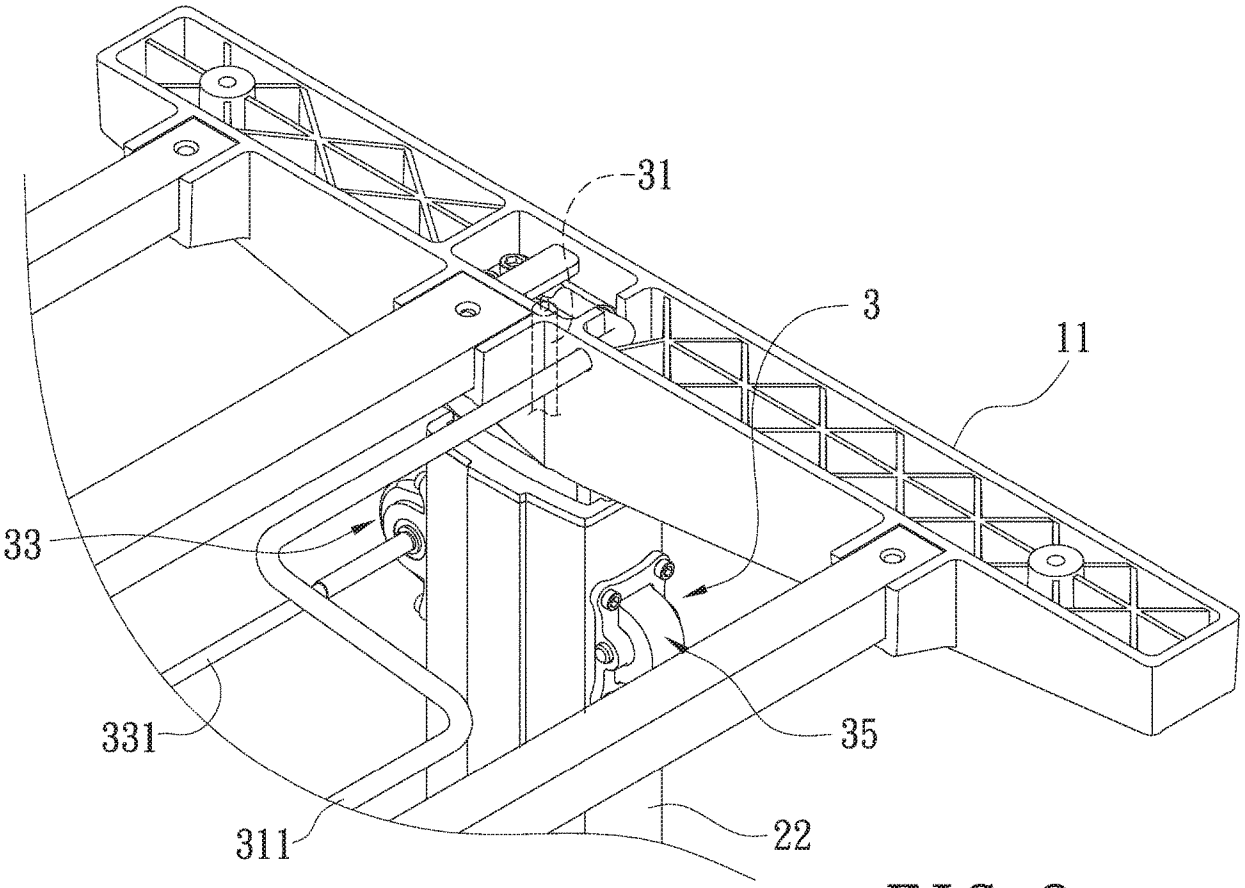
FIG. 2 is a partial enlarged view showing an elevating apparatus of a table according to the present invention.
Figure 3:
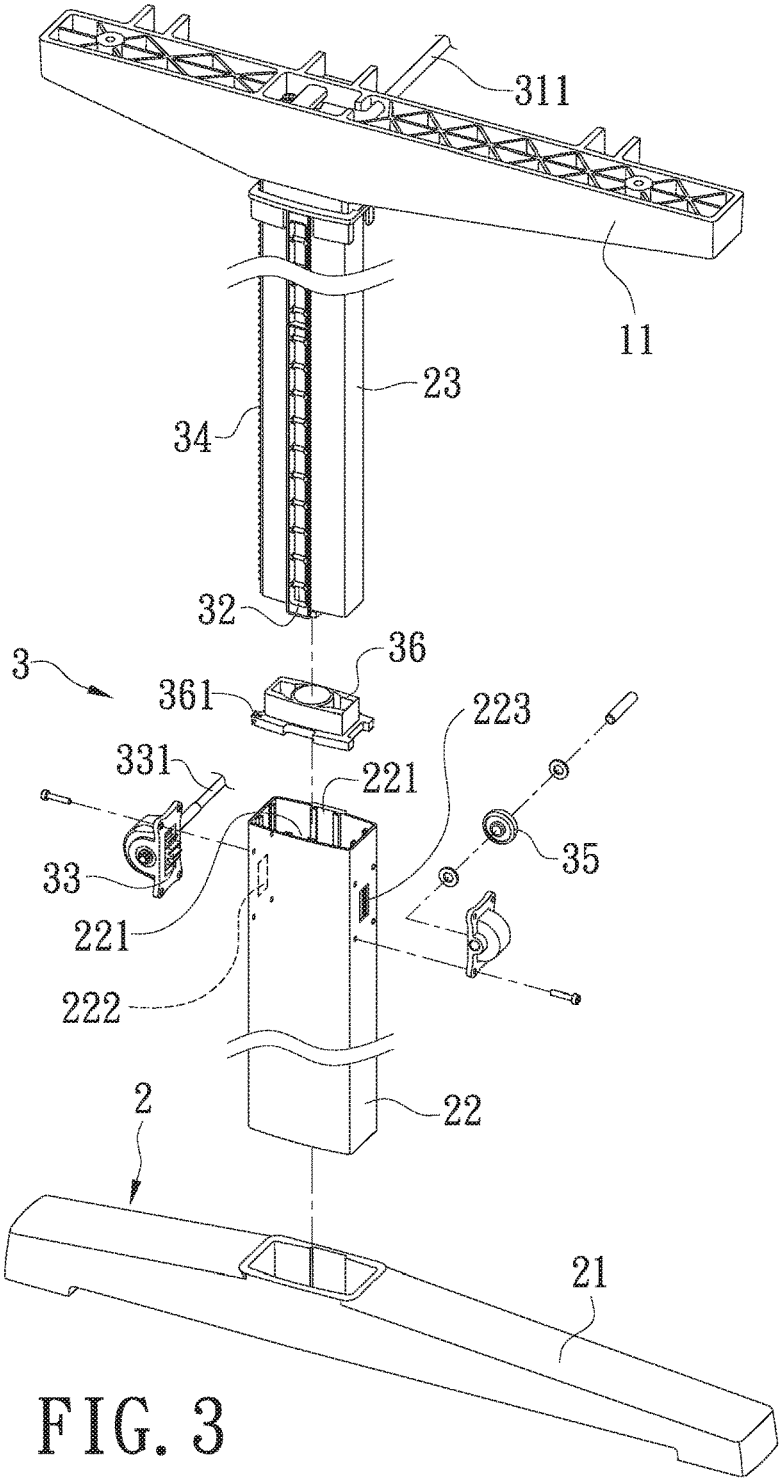
FIG. 3 is an exploded diagram showing an elevating apparatus of a table according to the present invention.
Figure 4:
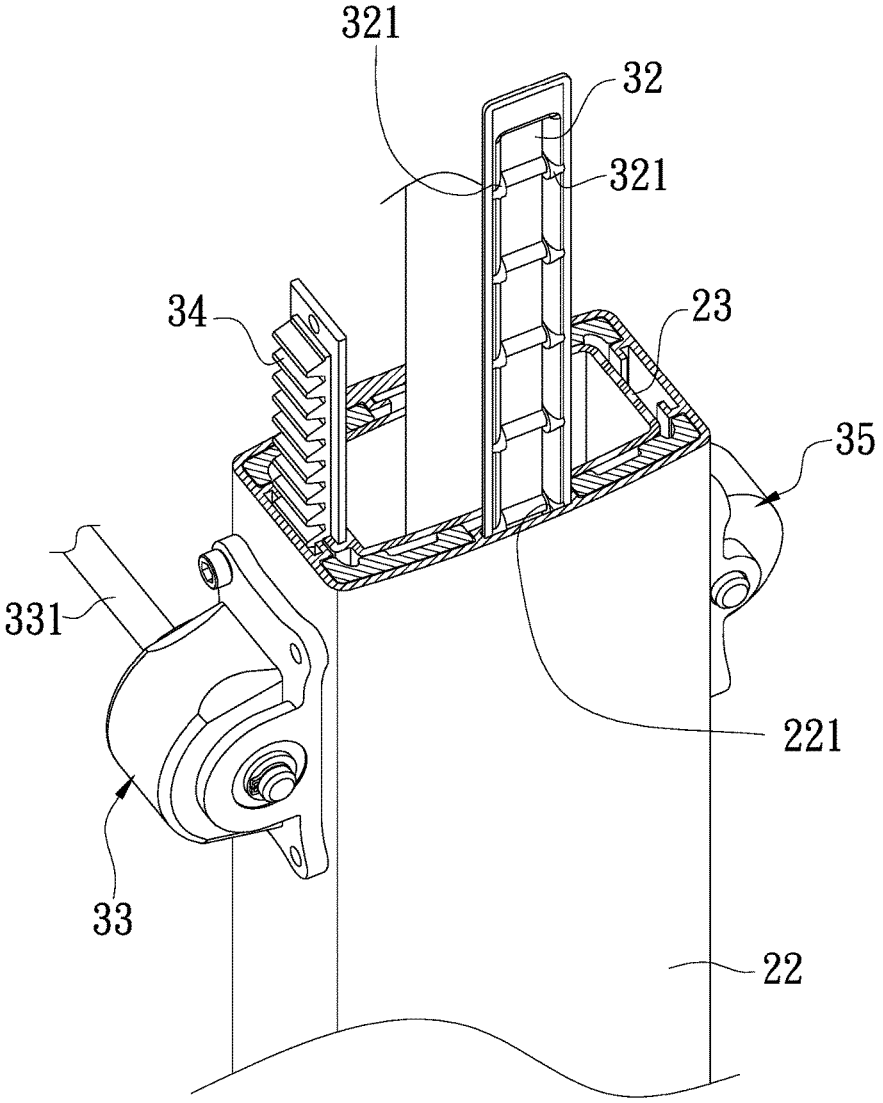
FIG. 4 is a schematic diagram showing a partial of an elevating apparatus of a table according to the present invention.
Figure 5:
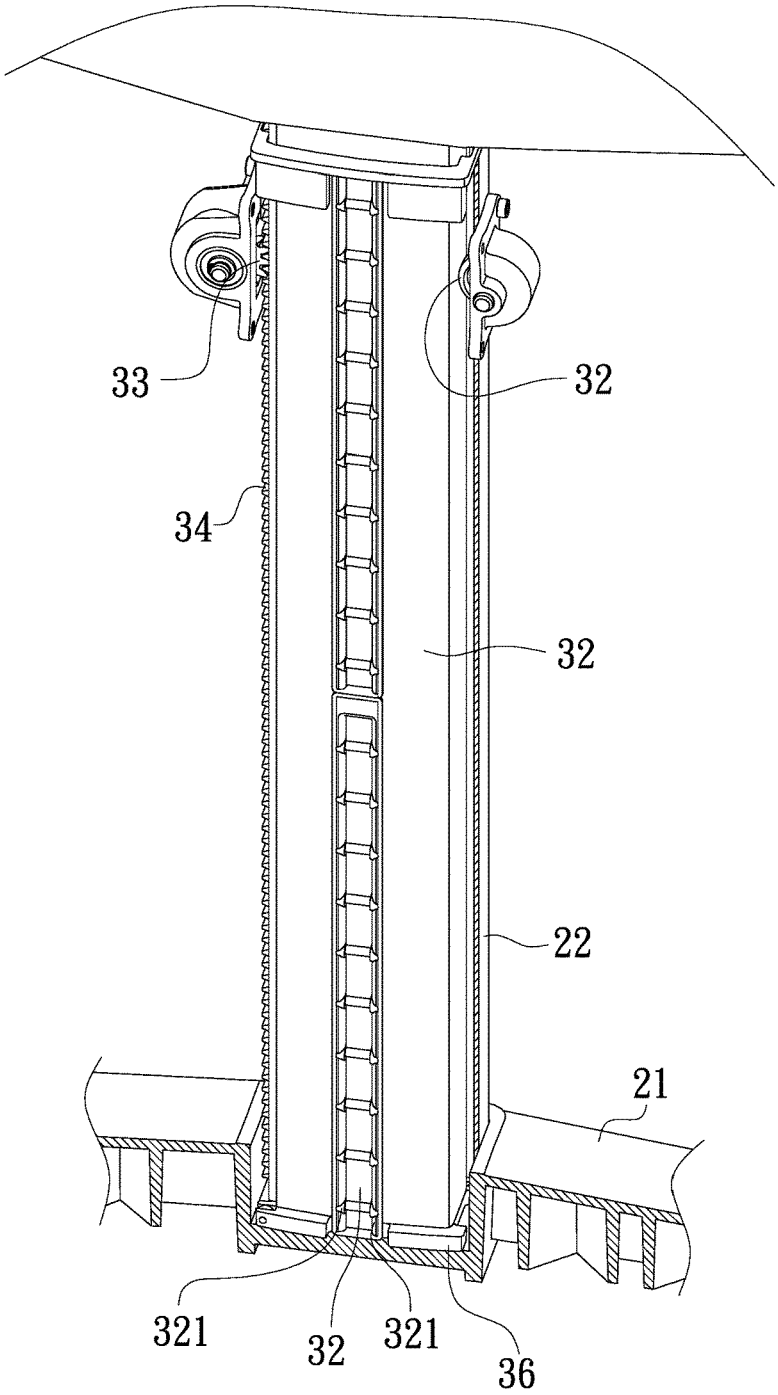
FIG. 5 is a partial enlarged view showing an elevating apparatus of a table in assembly according to the present invention.
Figure 6:
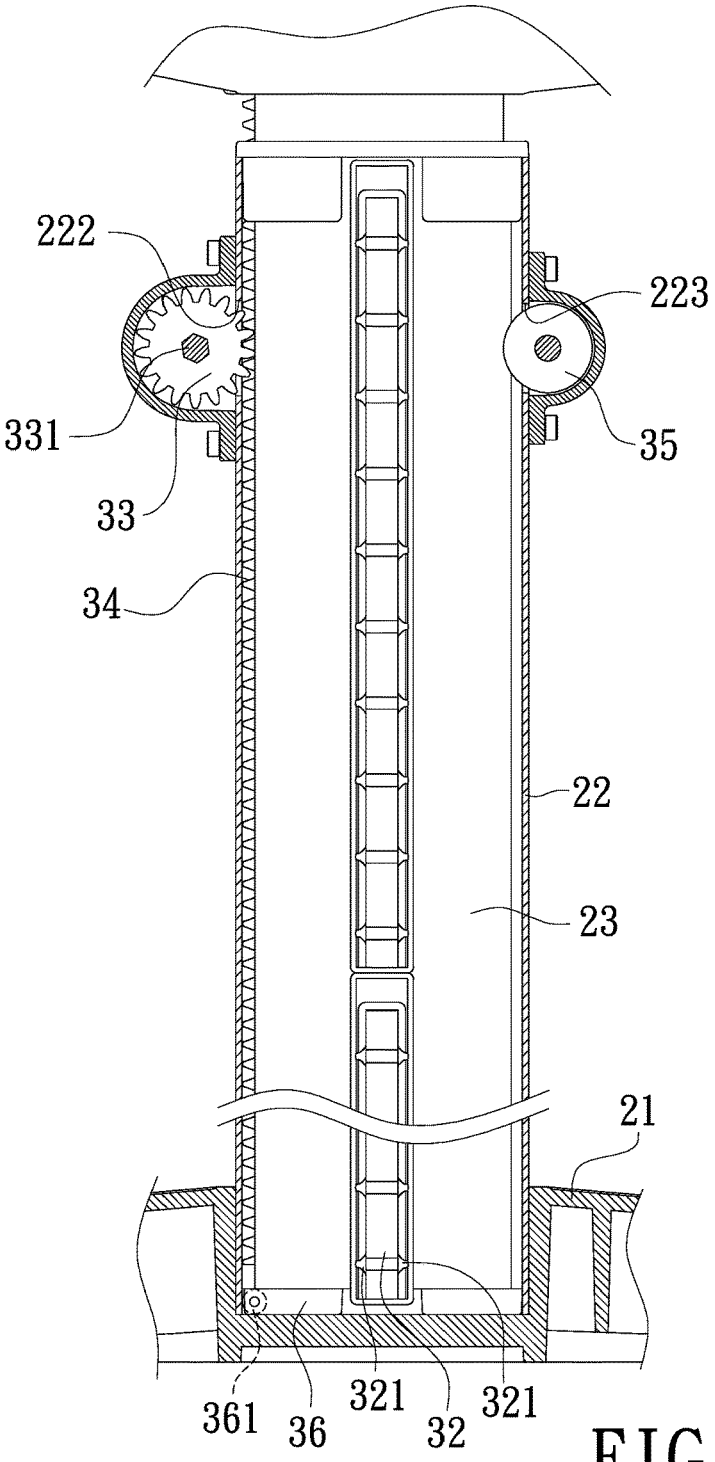
FIG. 6 is a sectional view showing an elevating apparatus of a table according to the present invention.
Figure 7:
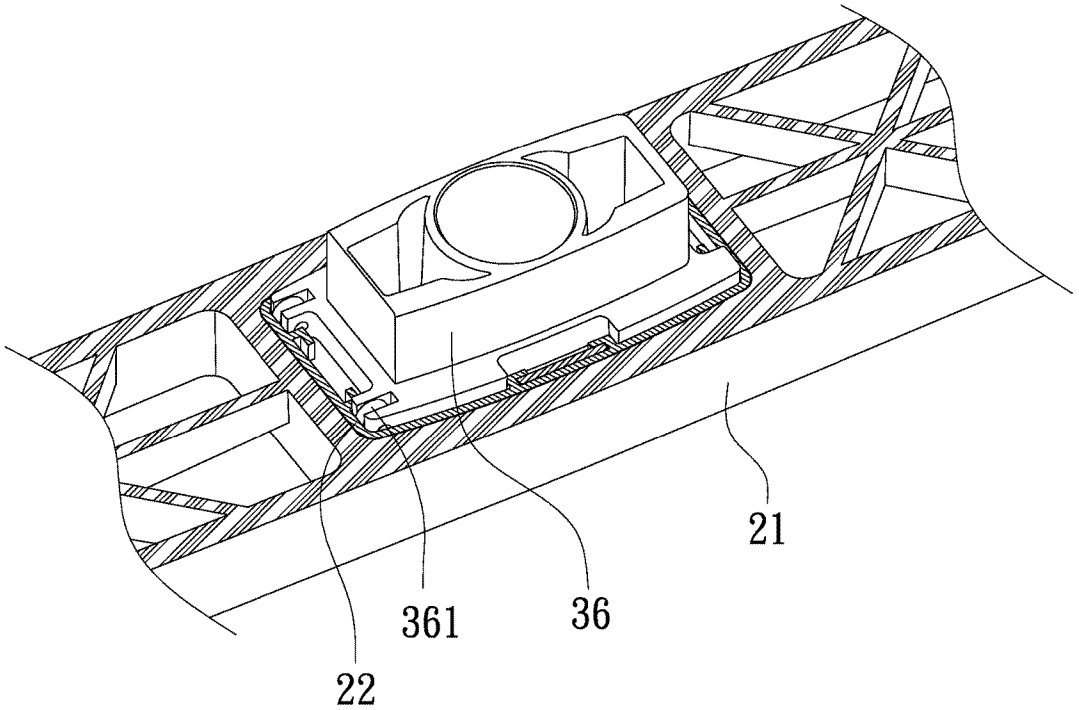
FIG. 7 is a schematic diagram showing a supporting base in contact with an internal side of a hollow outer column according to the present invention.

Please refer to FIG. 1 showing a stereogram of the present invention, FIG. 2 showing a partial enlarged view of the present invention and FIG. 3 showing an exploded diagram of the present invention, the present invention comprises a board (1), two legs (2) and a height adjusting apparatus (3).

The two legs (2) are connected to two lateral members (11) of a bottom of the board (1) respectively.

Each of the two legs (2) has a leg base (21) at a bottom thereof, a hollow outer column (22) on the leg base (21) and an inner column (23) movably inserted into the hollow outer column (22) and connected to the board (1) at a top side thereof. The hollow outer column (22) has two guide rails (221) disposed on two internal sides of the hollow outer column (22) correspondingly, a teeth-guiding slot (222) disposed at one side adjacent to the internal side and a pulley slot (223) disposed at another side corresponding to the teeth-guiding slot (222).

Please refer to FIG. 4, FIG. 5, FIG. 6 and FIG. 7 which comprises a first schematic diagram, a partial enlarged view, a sectional view and a second schematic diagram of the present invention. The height adjusting apparatus (3) comprises gas springs, chutes (32), guide gears (33), gear racks (34) and pulleys (35). The gas spring is inserted into the inner column (23) of each of the two legs (2) and each gas spring has a control portion (31) thereon in which the control portions (31) of the two gas springs are controlled synchronously by an elevating control lever (311). The chute (32) is disposed outside the inner column (23) and corresponding to the guide rail (221) of the hollow outer column (22). The chute (32) is provided with plural arc portions (321) equally spaced apart from each other at two lateral sides thereof for contacting the guide rail (221). The guide gear (33) is pivotally connected to the teeth-guiding slot (222) of the hollow outer column (22), and an axle (331) is further provided to synchronously connect the two guide gears (33) pivotally connected to the two hollow outer columns (22) of the two legs (2). The gear rack (34) is disposed at one side of the inner column (23) adjacent to the guide gear (33) for correspondingly engaging with the guide gear (33). The pulley (35) is pivotally connected to the pulley slot (223) of the hollow outer column (22) for contacting the inner column (23). The height adjusting apparatus (3) is further provided with a supporting base (36) connected to a bottom of the inner column (23) and having a supporting pulley (361) pivotally connected to one side of the supporting base (36) corresponding to the pulley (35) for contacting the internal side of the hollow outer column (22).

Accordingly, in use of the present invention, the control portion (31) of the gas spring is controlled by the elevating control lever (311) of the height adjusting apparatus (3) synchronously to drive the inner columns (23) of the two legs (2) lift or lower for adjusting the height of the board (1). During the adjusting process, the gear rack (34) of the inner column (23) is driven by the guide gear (33) engaged with the gear rack (34) to move, and the inner column (23) is then moved successfully and synchronously inside the hollow outer column (22). In addition, the chute (32) of the inner column (23) slides along the guide rail (221) of the hollow outer column (22) by the plural arc portions (321) on two lateral sides thereof. The hollow outer column (22) is contacted to the inner column (23) by the pulley (35) pivotally connected to the hollow outer column (22), and the supporting pulley (361) pivotally connected to the supporting base (36) at a bottom of the inner column (23) is contacted to the internal side of the hollow outer column (22), so the inner column (23) can move smoothly and non-titled inside the hollow outer column (22) for adjusting the height of the table.

Compared to the existing technical features, the present invention can adjust a height of a table smoothly and non-tilted by elevating or lowering the inner columns inside the hollow outer columns of the legs synchronously and the height of the board disposed on the inner columns of the legs is adjusted. The present invention achieves effects of diverse application by different users and increases practicality in its overall application.

However, the aforementioned embodiments or figures are not is intended to limit the structure or use of the present invention, and alternations or modifications within the spirit and technical scope of the present invention should be considered as not departing from the scope of the invention.

What is claimed is:

1. An elevating apparatus of a table, comprising:

a board;

two legs respectively connected to two lateral members disposed at a bottom of the board, and each leg having a leg base at a bottom thereof, a hollow outer column disposed on the leg base and having a guide rail disposed on an internal side of at least a first side of the hollow outer column, a teeth-guiding slot formed in a second side of the hollow outer column adjacent to the first side thereof and a pulley slot formed in a third side of the hollow outer column and disposed in opposing relationship to the teeth-guiding slot, and each leg further having an inner column movably inserted into the hollow outer column and connected to the board at a top side thereof; and a height adjusting apparatus having a gas spring inserted into the inner column of each of the two legs, and each leg including a chute disposed on an outer surface of a first side of the inner column in correspondence with the guide rail of the hollow outer column, a gear rack disposed on a second side of the inner column adjacent to the second side of the hollow outer column and in correspondence with the teeth-guiding slot, a guide gear pivotally coupled to the teeth-guiding slot of the hollow outer column and in toothed engagement with the gear rack, and a pulley pivotally connected to the pulley slot of the hollow outer column and disposed in contact with a third side of the inner column, the third side being opposite to the second side of the inner column, wherein the chute of each inner column is provided with plural arc portions equally spaced apart from each other at two lateral sides thereof for contact with the guide rail.

2. The elevating apparatus of a table as claimed in claim 1, wherein the hollow outer column of each of the two legs is provided with a second guide rail disposed on an internal side of a fourth side of the hollow outer column, the fourth side being opposite the first side of the hollow outer column.

3. The elevating apparatus of a table as claimed in claim 1, wherein the height adjusting apparatus further includes a supporting base connected to a bottom of each inner column, the supporting base having a supporting pulley pivotally connected to a side thereof in correspondence with the second side of the inner column and disposed in contact with an internal surface of the second side of the hollow outer column.

4. The elevating apparatus of a table as claimed in claim 1, wherein the height adjusting apparatus further includes an elevating control lever extending between the two lateral members for contacting a control portion of the gas spring in each of the inner columns for operatively controlling displacement of the gas springs.

5. The elevating apparatus of a table as claimed in claim 1, wherein the pivotal coupling of the guide gear of each hollow outer column includes an axle coupled on opposing ends to a respective guide gear to synchronize rotative displacement therebetween and thereby synchronize displacement between the two inner columns relative to corresponding hollow outer columns to move in unison.

* * * * *